US012478101B2

(12) United States Patent
Li et al.

(10) Patent No.: US 12,478,101 B2
(45) Date of Patent: Nov. 25, 2025

(54) ELECTRONIC VAPORIZATION DEVICE AND VAPORIZATION CORE THEREOF

(71) Applicant: Hainan Moore Brothers Technology Co., Ltd., Hainan (CN)

(72) Inventors: Bo Li, Hainan (CN); Yaohua Zhang, Hainan (CN); Feng Chen, Hainan (CN); Jicai Long, Hainan (CN); Fei Chen, Hainan (CN); Hongming Zhou, Hainan (CN)

(73) Assignee: Hainan Moore Brothers Technology Co., Ltd., Hainan (CN)

( * ) Notice: Subject to any disclaimer, the term of this patent is extended or adjusted under 35 U.S.C. 154(b) by 176 days.

(21) Appl. No.: 18/183,381

(22) Filed: Mar. 14, 2023

(65) Prior Publication Data

US 2023/0309619 A1 Oct. 5, 2023

(30) Foreign Application Priority Data

Mar. 31, 2022 (CN) ..... 202210336206.6

(51) Int. Cl.
*A24F 40/46* (2020.01)
*A24F 40/10* (2020.01)
*A24F 40/44* (2020.01)

(52) U.S. Cl.
CPC ..... *A24F 40/46* (2020.01); *A24F 40/10* (2020.01); *A24F 40/44* (2020.01)

(58) Field of Classification Search
CPC ..... A24F 40/46; A24F 40/44
See application file for complete search history.

(56) References Cited

U.S. PATENT DOCUMENTS

| | | | | |
|---|---|---|---|---|
| 4,777,153 | A | 10/1988 | Sonuparlak et al. | |
| 2017/0112193 | A1* | 4/2017 | Chen | A24F 40/46 |
| 2019/0098935 | A1 | 4/2019 | Phan et al. | |
| 2020/0054075 | A1* | 2/2020 | Zhang | A24F 40/44 |
| 2022/0070978 | A1 | 3/2022 | Muneishi | |
| 2022/0071290 | A1 | 3/2022 | Zhou et al. | |

(Continued)

FOREIGN PATENT DOCUMENTS

| | | | |
|---|---|---|---|
| CN | 113115986 | A | 7/2012 |
| CN | 105394816 | A | 3/2016 |
| CN | 207897890 | U | 9/2018 |

(Continued)

OTHER PUBLICATIONS

Chinese Patent Office, Office Action in Chinese Patent Application No. 202220737587.4 (Nov. 13, 2023).
Chinese Patent Office, Office Action in Chinese Patent Application No. 202220733298.7 (Nov. 13, 2023).
Chinese Patent Office, Office Action in Chinese Patent Application No. 202220733299.1 (Nov. 13, 2023).

(Continued)

*Primary Examiner* — Michael H. Wilson
*Assistant Examiner* — Courtney G Culbert
(74) *Attorney, Agent, or Firm* — Leydig, Voit & Mayer, Ltd.

(57) ABSTRACT

A vaporization core for an electronic vaporization device includes: a porous body; and a heating film arranged on a surface of the porous body. The porous body has at least one unit layer, the at least one unit layer having a liquid storage advantage layer and a liquid locking advantage layer combined with the liquid storage advantage layer. The heating film is combined with a surface of the liquid locking advantage layer and at least partially infiltrates in the liquid locking advantage layer.

16 Claims, 7 Drawing Sheets

(56) References Cited

U.S. PATENT DOCUMENTS

| | | | | |
|---|---|---|---|---|
| 2022/0225679 | A1 | 7/2022 | Zhou et al. | |
| 2022/0312844 | A1* | 10/2022 | Zhou | H05B 3/42 |

FOREIGN PATENT DOCUMENTS

| | | | | |
|---|---|---|---|---|
| CN | 109105958 | A | | 1/2019 |
| CN | 109259331 | A | | 1/2019 |
| CN | 109527657 | A | | 3/2019 |
| CN | 109721344 | A | | 5/2019 |
| CN | 109875123 | A | | 6/2019 |
| CN | 109984387 | A | | 7/2019 |
| CN | 110710731 | A | | 1/2020 |
| CN | 110720675 | A | | 1/2020 |
| CN | 110876494 | A | | 3/2020 |
| CN | 111700310 | A | | 9/2020 |
| CN | 211746958 | U | | 10/2020 |
| CN | 112006329 | A | | 12/2020 |
| CN | 112167725 | A | | 1/2021 |
| CN | 212520793 | U | | 2/2021 |
| CN | 112931952 | A | | 6/2021 |
| CN | 113331484 | A | | 9/2021 |
| CN | 113475770 | A | | 10/2021 |
| CN | 113647696 | A | | 11/2021 |
| CN | 113712279 | A | | 11/2021 |
| CN | 215422802 | U | * | 1/2022 |
| CN | 215936305 | U | | 3/2022 |
| CN | 114668182 | A | | 6/2022 |
| CN | 114668183 | A | | 6/2022 |
| CN | 114847532 | A | | 8/2022 |
| CN | 112888093 | B | | 10/2022 |
| EP | 3510880 | A1 | | 7/2019 |
| IN | 215422802 | U | | 1/2022 |
| JP | 202211691 | A | | 1/2022 |
| TW | M590368 | U | | 2/2020 |
| WO | 2018197511 | A1 | | 11/2018 |
| WO | 2019137099 | A1 | | 7/2019 |
| WO | 2020138330 | A1 | | 7/2020 |
| WO | 20220228330 | A1 | | 11/2020 |
| WO | 2021027417 | A1 | | 2/2021 |

OTHER PUBLICATIONS

Chinese Patent Office, Rejection Decision in Chinese Patent Application No. 202220737587.4 (Jan. 17, 2024).
Chinese Patent Office, Rejection Decision in Chinese Patent Application No. 202220733298.7 (Jan. 17, 2024).
Chinese Patent Office, Rejection Decision in Chinese Patent Application No. 202220733299.1 (Jan. 17, 2024).
Patent Cooperation Treaty, Written Opinion, International Application No. PCT/CN2022/133573 (Feb. 6, 2023).
Patent Cooperation Treaty, Written Opinion, International Application No. PCT/CN2022/133577 (Feb. 9, 2023).
Patent Cooperation Treaty, Written Opinion, International Application No. PCT/CN2022/133575 (Feb. 15, 2023).
European Patent Office, Search Report in European Patent Application No. 23162521.1 (Aug. 3, 2023).
European Patent Office, Search Report in European Patent Application No. 23162522.9 (Aug. 3, 2023).
European Patent Office, Search Report in European Patent Application No. 23162523.7 (Aug. 3, 2023).
Patent Cooperation Treaty, International Search Report, International Application No. PCT/CN2022/133573 (Feb. 6, 2023).
Patent Cooperation Treaty, International Search Report, International Application No. PCT/CN2022/133577 (Feb. 9, 2023).
Patent Cooperation Treaty, International Search Report, International Application No. PCT/CN2022/133575 (Feb. 15, 2023).
Chinese Patent Office, Office Action in Chinese Patent Application No. 202210333484.5 (Jun. 28, 2024).
Chinese Patent Office, Office Action in Chinese Patent Application No. 202210336206.6 (Jun. 28, 2024).
U.S. Patent and Trademark Office, Office Action in U.S. Appl. No. 18/176,141 (May 19, 2025).
U.S. Patent and Trademark Office, Office Action in U.S. Appl. No. 18/175,871 (May 19, 2025).
European Patent Office, Office Action in European Patent Application No. 23162522.9 (Jul. 1, 2025).
Chinese Patent Office, Office Action in Chinese Patent Application No. 202210336213.6 (Jul. 19, 2025).

* cited by examiner

ELECTRONIC VAPORIZATION DEVICE AND VAPORIZATION CORE THEREOF

CROSS-REFERENCE TO PRIOR APPLICATION

Priority is claimed to Chinese Patent Application No. 202210336206.6, filed on Mar. 31, 2022, the entire disclosure of which is hereby incorporated by reference herein.

FIELD

The present invention relates to the field of electronic vaporization, and more specifically, to an electronic vaporization device and a vaporization core thereof.

BACKGROUND

An electronic vaporization device in the related technology usually includes a liquid storage cavity for accommodating a liquid aerosol-generation substrate and a vaporization core in connection with the liquid storage cavity in a liquid guiding manner. An energized vaporization core can generate heat to heat and vaporize the liquid aerosol-generation substrate, to form an aerosol. The vaporization core is a core component of the electronic vaporization device, and in the related technologies, most of the vaporization cores use a porous ceramic vaporization core, including a porous body and a heating film combined with a surface of the porous body. However, heat and mass transfer efficiency of the vaporization core in the related technologies is low, and it is likely to have a defect of e-liquid explosion.

SUMMARY

In an embodiment, the present invention provides a vaporization core for an electronic vaporization device, comprising: a porous body; and a heating film arranged on a surface of the porous body, wherein the porous body comprises at least one unit layer, the at least one unit layer comprising a liquid storage advantage layer and a liquid locking advantage layer combined with the liquid storage advantage layer, and wherein the heating film is combined with a surface of the liquid locking advantage layer and at least partially infiltrates in the liquid locking advantage layer.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
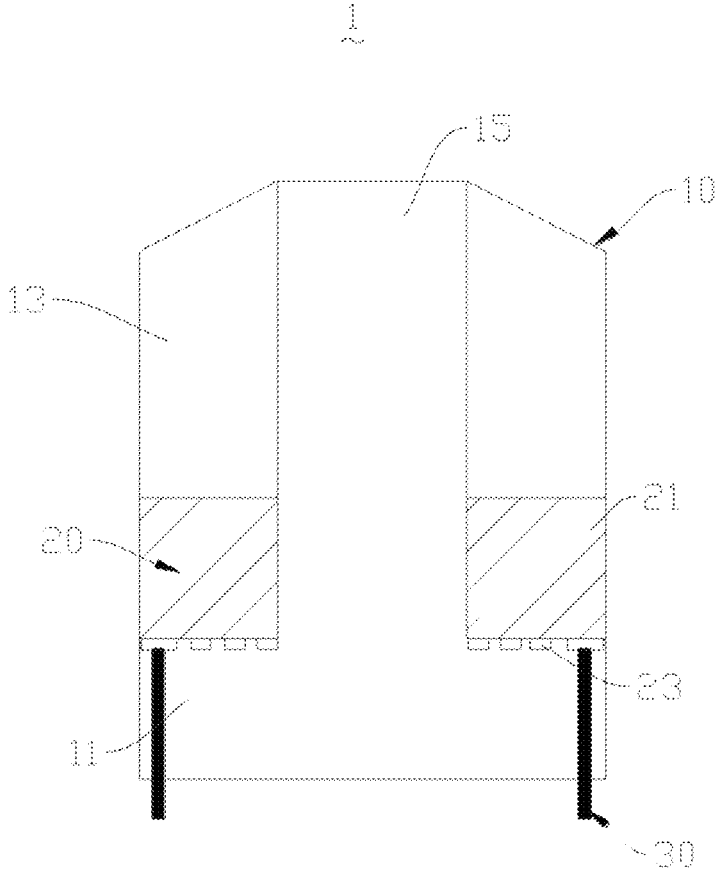
FIG. 1 is a longitudinal cross-sectional view of an electronic vaporization device according to some embodiments of the present invention.

In an embodiment, the present invention provides an improved electronic vaporization device and a vaporization core thereof.

In an embodiment, the present invention provides a vaporization core, configured for an electronic vaporization device, including a porous body and a heating film arranged on a surface of the porous body, where the porous body includes at least one unit layer, the at least one unit layer includes a liquid storage advantage layer and a liquid locking advantage layer combined with the liquid storage advantage layer, and the heating film is combined with a surface of the liquid locking advantage layer and at least partially infiltrates in the liquid locking advantage layer.

In some embodiments, the porous body includes a first surface, a second surface opposite to the first surface, the at least one unit layer includes at least two unit layers, the at least two unit layers are sequentially arranged along a direction from the first surface to the second surface, one of the at least two unit layers includes at least a liquid locking advantage layer, and each of other unit layers of the at least two unit layers includes a liquid storage advantage layer and a liquid locking advantage layer combined with the liquid storage advantage layer; and the heating film is combined with a surface of an outermost liquid locking advantage layer of the at least two unit layers.

In some embodiments, each of the at least two unit layers includes a liquid storage advantage layer and a liquid locking advantage layer combined with the liquid storage advantage layer, and the liquid storage advantage layers and the liquid locking advantage layers of the at least two unit layers are stacked together along the direction from the first surface to the second surface.

In some embodiments, the thickness of the liquid locking advantage layer ranges from 10 μm to 200 μm. In some embodiments, the thickness of the porous body ranges from 0.8 mm to 3.0 mm.

In some embodiments, an average porosity of the porous body ranges from 50% to 75%. In some embodiments, the thickness of each unit layer ranges from 0.1 mm to 1.5 mm.

In some embodiments, the liquid storage advantage layer includes a large-pore-size structure layer, the liquid locking advantage layer includes a small-pore-size structure layer, and an average pore size of the large-pore-size structure layer is 1.5 to 2.5 times of an average pore size of the small-pore-size structure layer.

In some embodiments, the liquid storage advantage layer includes a large-pore-size structure layer, the liquid locking advantage layer includes a small-pore-size structure layer, an average pore size of the large-pore-size structure layer ranges from 50 μm to 150 μm, and an average pore size of the small-pore-size structure layer ranges from 20 μm to 100 μm.

In some embodiments, the liquid storage advantage layer includes a high porosity layer, the liquid locking advantage layer includes a low porosity layer, and a porosity of the high porosity layer is 1.2 to 2 times of a porosity of the low porosity layer.

In some embodiments, the liquid storage advantage layer includes a high porosity layer, the liquid locking advantage layer includes a low porosity layer, a porosity of the high porosity layer ranges from 55% to 90%, and a porosity of the low porosity layer ranges from 55% to 90%.

In some embodiments, the porous body may be porous alumina ceramic, porous silicon oxide, porous cordierite, porous silicon carbide, porous silicon nitride, porous mullite, or composite porous ceramic formed integrally.

In some embodiments, the heating film is a porous heating film.

In some embodiments, the thickness of the heating film ranges from 15 μm to 150 μm or from 1 μm to 5 μm. In some embodiments, an infiltration ratio of the heating film is less than 60%.

An electronic vaporization device is further provided, including the vaporization core according to any one of the foregoing.

Beneficial effects of the present invention are as follows: With a combination of the liquid storage advantage layer and the liquid locking advantage layer of the porous body, a steeper gradient drop can be achieved and a stronger heat and mass transfer driving force can be provided; and in addition, the heating film is arranged on the liquid locking advantage layer, to reduce an infiltration ratio and alleviate a defect of e-liquid explosion.

To provide a clearer understanding of the technical features, objectives, and effects of the present invention, specific implementations of the present invention are described in detail with reference to the accompanying drawings.

Figure 2:
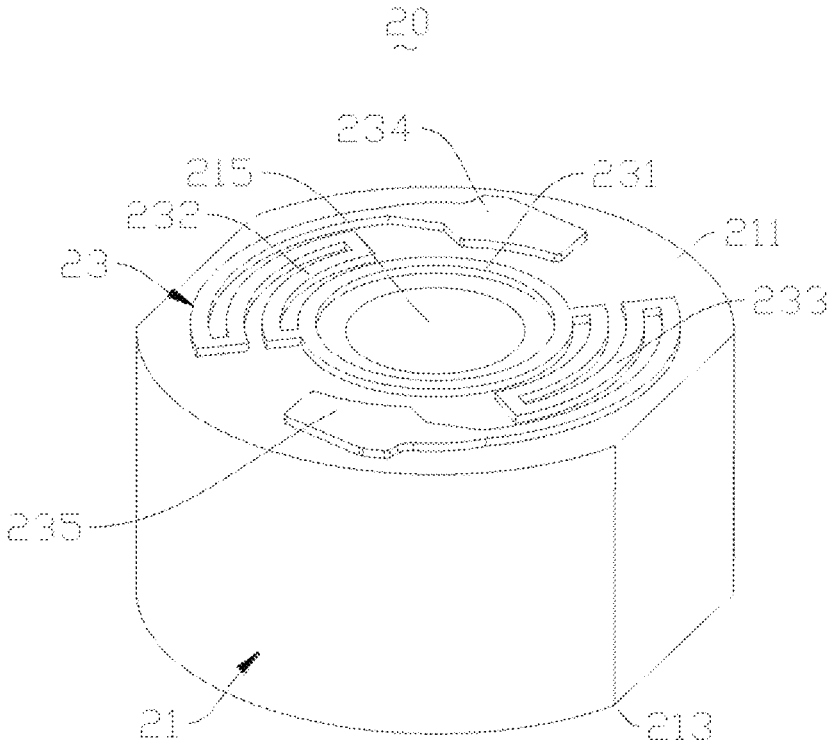
FIG. 2 is a three-dimensional schematic structural diagram of a vaporization core shown in FIG. 1 with a bottom facing upward.

FIG. 1 and FIG. 2 show an electronic vaporization device 1 according to some embodiments of the present invention, and the electronic vaporization device 1 may be configured to heat and vaporize a liquid aerosol-generation substrate for inhalation by a user. In some embodiments, the electronic vaporization device 1 is in a shape of a flat column for convenience of hand holding. In some embodiments, the electronic vaporization device 1 includes a housing 10, a vaporization core 20 and a pair of electrodes 30. The housing 10 is configured to form a vaporization cavity 11, a liquid storage cavity 13, and an air outlet channel 15. The vaporization core 20 is arranged in the housing 10, and configured to heat and vaporize the liquid aerosol-generation substrate. The pair of electrodes 30 is electrically connected to the vaporization core 20, and configured to electronically connect the vaporization core 20 to a battery device. It may be understood that the electronic vaporization device 1 is not limited to the shape of a flat column, but may also be in a shape of a cylinder, a square column, or other irregular shapes.

As shown in FIG. 1, in some embodiments, the housing 10 may include a vaporization cavity 11, a liquid storage cavity 13, and an air outlet channel 15. The vaporization cavity 11 is arranged on a bottom end of the housing 10, and configured to accommodate an aerosol and mix the aerosol with ambient air. The air outlet channel 15 is longitudinally arranged in the housing 10 and is in communication with the vaporization cavity 11, and configured to export a mixture of the aerosol and the air. The liquid storage cavity 13 is arranged on an upper part of a vaporization core 12 and surrounds the air outlet channel 15, and configured to accommodate the liquid aerosol-generation substrate. An upper end of the housing 10 may form a flat suction nozzle in communication with the air outlet channel 15 to facilitate inhalation by the user.

As shown in FIG. 2, in some embodiments, the vaporization core 20 may include a porous body 21 and a heating element 23. The porous body 21 is configured to transmit the liquid aerosol-generation substrate in the liquid storage cavity 13 to the heating element 23 by a capillary force. The heating element 23 is arranged on the porous body 21, and configured to generate a high temperature after being energized, to heat and vaporize the liquid aerosol-generation substrate.

In some embodiments, the porous body 21 may be in a shape of a column, which may include a first surface 211, a second surface 213, and a center channel 215. The first surface 211 may be arranged on a bottom end of the porous body 21, and configured to install the heating element 23, to form a vaporization surface. The second surface 213 and the first surface 211 are arranged opposite to each other, and the second surface may be arranged on a top end of the porous body 21, and configured to be in communication with the liquid storage cavity 13 to form a liquid absorbing surface. The center channel 215 is arranged in the porous body 21 and extends from the first surface 211 to the second surface 213, and configured to communicate the vaporization cavity 11 with the air outlet channel 15. It may be understood that, the porous body 21 is not limited to the shape of a column, but may also be in a shape of a flat plate.

In some embodiments, the heating element 23 may be designed in a shape of a circle or a quasi-circle, which is more conducive to a full use of a heating surface. The length of an arc-shaped heating portion may be extended through a surrounding design of the arc-shaped heating portion in a small size, to obtain a higher resistance value. The surrounding design of the arc-shaped heating portion of the heating element 23 may fully gather heat. Combined with the small size brought by the shape of a circle or a quasi-circle, the temperature in the arc-shaped heating portion is further increased to produce more vapor.

In some embodiments, the heating element 23 may include a first heating unit 231, an arc-shaped second heating unit 232, and an arc-shaped third heating unit 233. The first heating unit 231 is arranged on the first surface 211 of the porous body 21 and configured to generate heat in a middle part. The second heating unit 232 and the third heating unit 233 are distributed on two opposite sides of the first heating unit 231 at intervals and symmetrically, and share a circle center with the first heating unit 231 for generating heat on both sides respectively. The second heating unit 232 and the third heating unit 233 are electrically connected to ends on different sides of the first heating unit 231 respectively.

In some embodiments, the vaporization core 20 may be integrally formed by the heating element 23 and the porous body 21 through binder removal and sintering; or the vaporization core may be formed by first preparing the porous body 21 and then preparing the heating element 23 through binder removal and sintering. The shapes of the porous body 21 and the heating element 23 may be not limited.

Figure 3:
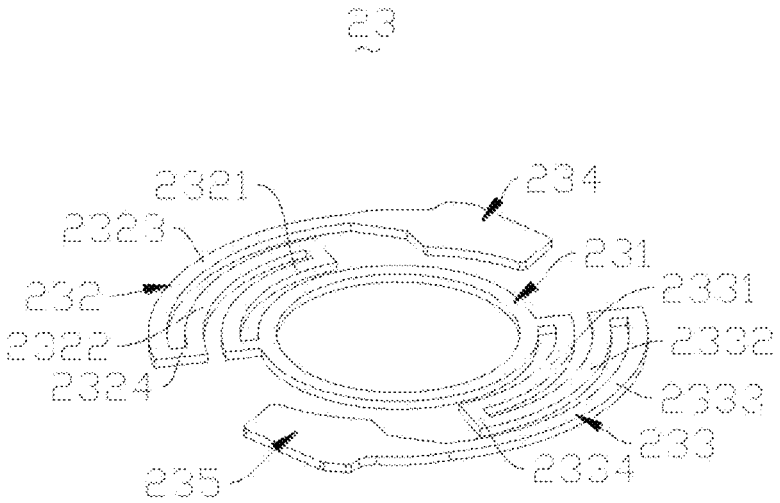
FIG. 3 is a three-dimensional schematic structural diagram of a heating element of a vaporization core shown in FIG. 1.

Referring to FIG. 3, in some embodiments, the first heating unit 231 may be in a shape of a circular ring, which may include a center through hole 2310, where the center through hole 2310 is in communication with the center channel 215 of the porous body 21. The center through hole 2310 realizes a direct connection between the vaporization cavity 11 and the suction nozzle. During inhalation, vapor is directly transmitted from the center through hole 2310 to the suction nozzle. An air passage is simple, which can not only alleviate condensation of vapor in the air passage, reduce blockage and leakage, and improve an amount of vapor, but also make vapor enter a mouth of an inhaler directly and quickly, to ensure an inhalation taste.

In some embodiments, the second heating unit 232 may include a first heating portion 2321, a second heating portion 2322, and a third heating portion 2323, which are also roughly arc-shaped. The first heating portion 2321, the second heating portion 2322, and the third heating portion 2323 share a circle center with the first heating unit 231 and are arranged in parallel and at intervals in sequence. It may be understood that the number of arc-shaped heating portions of the second heating unit 232 is not limited to three, but may be two or more than three.

The length of at least one arc-shaped heating portion close to the center through hole 2310 in at least two arc-shaped heating portions of the second heating unit 232 is less than the length of at least one arc-shaped heating portion away from the center through hole 2310. In some implementations, the first heating portion 2321, the second heating portion 2322, and the third heating portion 2323 are sequentially away from the center through hole 2310; and the length of the first heating portion 2321 is less than the length of the second heating portion 2322, and the length of the second heating portion 2322 is less than the length of third heating portion 2323. Sequentially increasing lengths can increase a heating area of the heating portions and further increase the amount of vapor.

In some embodiments, the second heating unit 232 may also include three fourth heating portions 2324 that are roughly strip-shaped, two of the three fourth heating portions 2324 electrically connect the first heating portion 2321, the second heating portion 2322, and the third heating portion 2323 in series in sequence, and two ends of the other of the three fourth heating portions 2324 are respectively electrically connected to the first heating unit 231 and the first heating portion 2321.

In some embodiments, the third heating unit 233 may include a fifth heating portion 2331, a sixth heating portion 2332, and a seventh heating portion 2333, which are also roughly arc-shaped. The fifth heating portion 2331, the sixth heating portion 2332, and the seventh heating portion 2333 share a circle center with the first heating unit 231 and are arranged in parallel and at intervals in sequence. It may be understood that the number of arc-shaped heating portions of the third heating unit 233 is not limited to three, but may be two or more than three.

The length of at least one arc-shaped heating portion close to the center through hole 2310 in at least two arc-shaped heating portions of the third heating unit 233 is less than the length of at least one arc-shaped heating portion away from the center through hole 2310. In some implementations, the fifth heating portion 2331, the sixth heating portion 2332, and the seventh heating portion 2333 are sequentially away from the center through hole 2310; and the length of the fifth heating portion 2331 is less than the length of the sixth heating portion 2332, and the length of the sixth heating portion 2332 is less than the length of seventh heating portion 2333. Sequentially increasing lengths can increase a heating area of the heating portions and further increase the amount of vapor.

In some embodiments, the third heating unit 233 may also include three eighth heating portions 2334 that are roughly strip-shaped, two of the three eighth heating portions 2334 electrically connect the fifth heating portion 2331, the sixth heating portion 2332, and the seventh heating portion 2333 in series in sequence, and two ends of the other of the three eighth heating portions 2334 are respectively electrically connected to the first heating unit 231 and the fifth heating portion 2331.

One end of the other of the three fourth heating portions 2324 and one end of the other of the three eighth heating portions 2334 are respectively connected to two opposite sides of the first heating unit 231, so as to electrically connect the second heating unit 232 and the third heating unit 233 to the first heating unit 231.

As shown in FIG. 2 and FIG. 3, in some embodiments, the heating element 23 may further include a first electrode connecting unit 234 and a second electrode connecting unit 235. The first electrode connecting unit 234 and the second electrode connecting unit 235 are arranged on the other two opposite sides of the first heating unit 231 in parallel and at intervals, connected to the other ends of the third heating portion 2323 and the seventh heating portion 2333 respectively, and configured to be electrically connected to the pair of electrodes 30.

Figure 4:
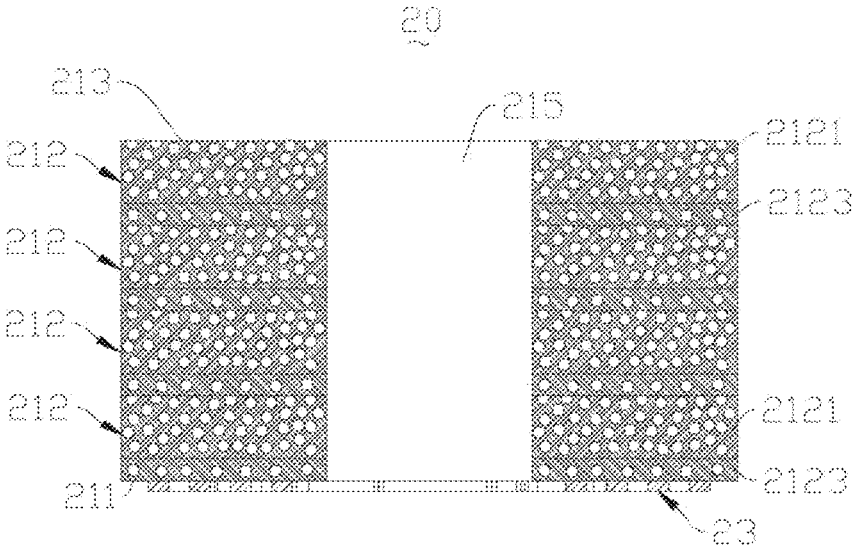
FIG. 4 is a schematic longitudinal sectional structural view of a vaporization core shown in FIG. 1.

Referring to FIG. 4, in some embodiments, the porous body 21 may include n ($2 \leq n \leq 30$) unit layers 212, and these unit layers 212 are stacked along a direction from the first surface 211 to the second surface 213. Each unit layer 212 may include a liquid storage advantage layer 2121 away from the first surface 211 and a liquid locking advantage layer 2123 close to the first surface 211, so that the liquid storage advantage layer 2121 and the liquid locking advantage layer 2123 of the porous body 21 are alternately arranged, to realize a steeper gradient drop than that of a porous body of the same thickness with a single porosity, so as to provide a stronger heat and mass transfer driving force and provide a faster liquid supplying capability for inhalation.

In some embodiments, the thickness of the porous body 21 (a distance from the first surface 211 to the second surface 213) may range from 0.8 mm to 3.0 mm, and an average porosity thereof may range from 50% to 75%. The thickness of each unit layer 212 may range from 0.10 mm to 1.5 mm, and the thickness of the liquid locking advantage layer 2123 of each unit layer 212 may range from 10 μm to 200 μm.

It may be understood that, in some embodiments, the unit layers 212 of the porous body 21 are not limited to including both the liquid storage advantage layer 2121 and the liquid locking advantage layer 2123, and part of the unit layers 212 may include either the liquid storage advantage layer 2121 or the liquid locking advantage layer 2123.

As shown in FIG. 4, in the embodiments, the liquid storage advantage layer 2121 may be a high porosity layer, and the liquid locking advantage layer 2123 may be a low porosity layer, where the liquid locking advantage layer 2123 provides the porous body 21 with a stronger support and liquid locking function than the liquid storage advantage layer 2121; and the liquid storage advantage layer 2121 provides the porous body 21 with functions such as a larger amount of liquid storage, faster liquid supplying, and stronger heat insulation than the liquid locking advantage layer 2123, so as to reduce a heat loss and provide a higher energy utilization rate for the vaporization core 20.

In some embodiments, a porosity of the liquid storage advantage layer 2121 is 1.2 to 2 times of a porosity of the liquid locking advantage layer 2123. In some embodiments, the porosity of the liquid storage advantage layer 2121 may range from 55% to 90%, and the porosity of the liquid locking advantage layer 2123 may range from 45% to 70%.

In some embodiments, the porous body 21 may be porous alumina ceramic, porous silicon oxide, porous cordierite, porous silicon carbide, porous silicon nitride, porous mullite, or composite porous ceramic formed integrally. It may be understood that the porous body 21 is not limited thereto, and may also be made of other materials suitable for flow casting or coating.

Figure 5:
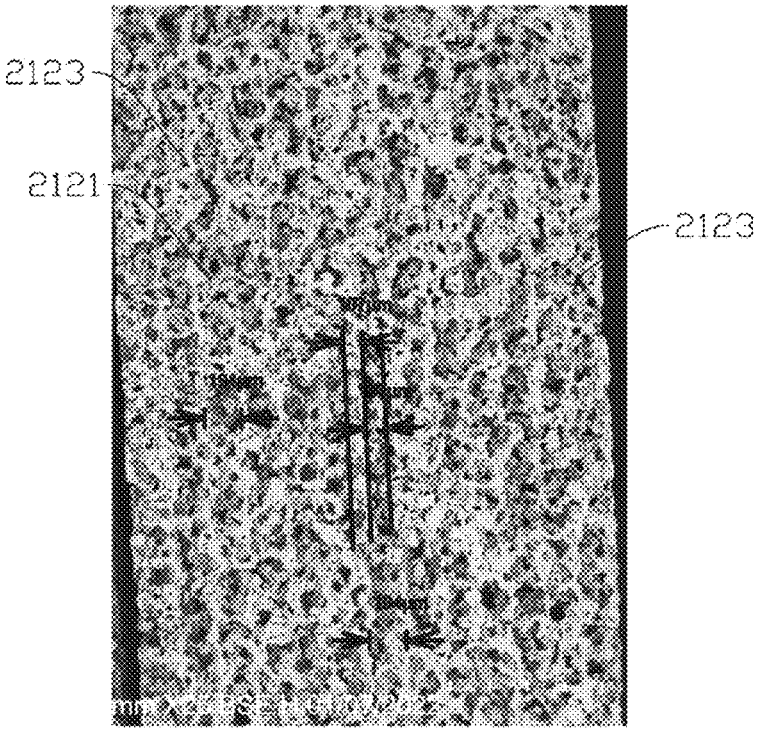
FIG. 5 is an electron microscope diagram of a porous body of a vaporization core shown in FIG. 1.

FIG. 5 shows an electron microscope diagram of a porous body 21 according to some embodiments. It may be clearly seen from the figure that the porous body 21 includes a plurality of alternately arranged liquid storage advantage layers 2121 and liquid locking advantage layers 2123, where the thickness of each liquid storage advantage layer 2121 is about 194 μm, and the thickness of each liquid locking advantage layer 2123 is about 20 μm.

Figure 6:
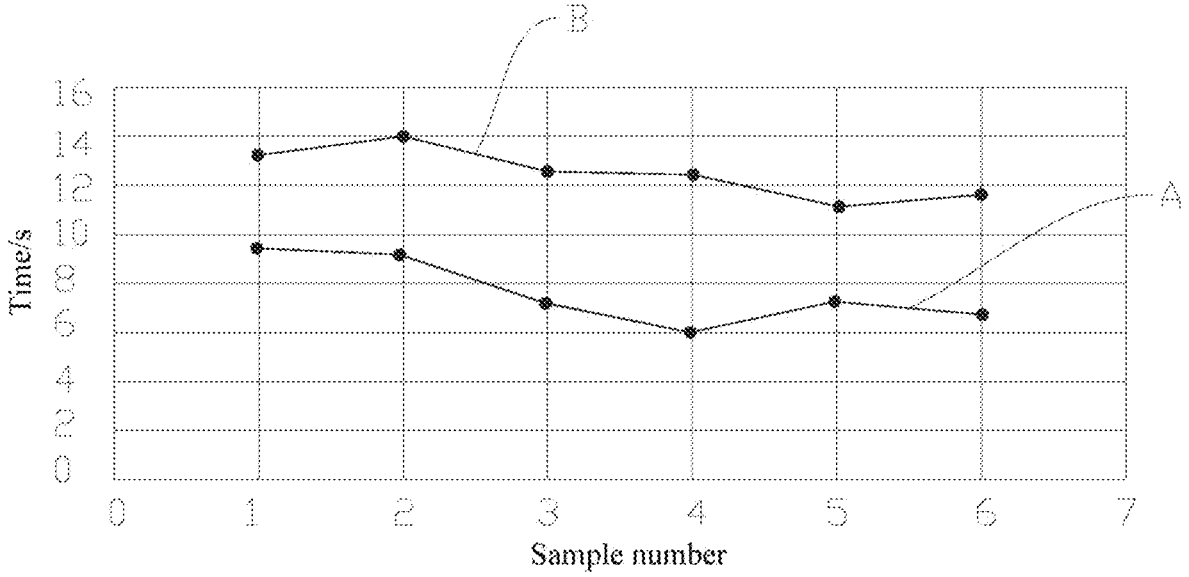
FIG. 6 is a comparison diagram of liquid guiding test data for a porous body of a vaporization core shown in FIG. 1.

FIG. 6 shows a comparison diagram of a rate curve of a liquid guiding test of a porous body 21 with a periodic layered structure and a porous body with a uniform porosity under the condition of the same thickness. In this test, the samples are all rectangular ceramic porous bodies, the test liquid is 30 mg of mung bean ice e-liquid, and the test time is the time when the liquid spreads from a liquid absorbing surface to a vaporization surface of the porous body. As shown in the figure, in different test processes, a liquid guiding rate of the porous body 21 with a periodic multilayer structure (a statistical curve of its liquid guiding rate is A) is significantly better than that of the porous body with a uniform porosity (the statistical curve of its liquid guiding rate is B).

In some embodiments, the porous body 21 may be formed by flow casting or extrusion, and specific examples are as follows:

(1) Flow casting process, the flow casting process itself is suitable for preparing a multilayer structure, and for example: (A) green compacts with different porosities may be flow cast first, and then a periodic layered structure may be prepared by periodically stacking and then co-firing the green compacts; and (B) it is also possible to prepare the periodic layered structure by adjusting a recipe by flowing green compacts with different porosities on the upper and lower sides at once according to the difference in density and particle size of each component in the recipe, thus showing the difference in suspension capabilities in the slurry, and then stacking and co-firing the multilayered green compacts.

(2) Using extrusion molding process, a variety of green compacts with different porosities are extruded by recipe adjustment, and then multilayered green compacts were stacked and co-fired to form the periodic layered structure.

(3) Preparing by combination of a variety of processes, for example, a green compact with a porosity is flow casted first, then a green compact with another porosity is extruded or injection molded, and then a variety of green compacts with different porosities are stacked and co-fired periodically to prepare the periodic layered structure.

(4) Using a coating process, an underlying substrate is a high porosity layer, followed by coating performed on the substrate and secondary sintering to form a surface low porosity layer. According to different porosity requirements, the formulation and molding parameters of the porous substrate material may be adjusted artificially to form a required porous substrate structure with hierarchical pores.

As shown in FIG. 4, in some embodiments, the heating element 23 may be a porous heating film, which may be covered on the first surface of the porous body 21 in communication with the vaporization cavity 11 by means of heating film screen printing, vacuum coating, and the like, that is, the surface of the liquid locking advantage layer 2123, and partially infiltrates into the liquid locking advantage layer 2123.

In some embodiments, according to the test data, when the infiltration ratio of the heating film is higher than 60%, it is easy to encounter a serious e-liquid explosion phenomenon, and when the infiltration ratio is lower than 60%, the e-liquid explosion problem can be significantly alleviated. The following table lists the comparison of the e-liquid explosion test of different types of vaporization cores 20, which also illustrates this point.

| Sample name | Film thickness (exposed part) (Unit: μm) | Infiltration ratio (accounting for the entire thickness of the heating film) | Vaporization performance |
|---|---|---|---|
| AT02 | 22 | 85% | Severe e-liquid explosion |
| T65-1# | 116 | 42% | Slight e-liquid explosion |
| T65-2# | 102 | 45% | Slight e-liquid explosion |

For the heating element 23 laid on the small porosity layer (the liquid locking advantage layer 2123), because the pore size of the small porosity layer (the liquid locking advantage layer 2123) is smaller, the amount of infiltration of the heating element 23 is fewer. The heating element 23 mainly infiltrates into the small porosity layer (the liquid locking advantage layer 2123), and the infiltration ratio is lower than 60%, which may avoid a severe e-liquid explosion phenomenon. In addition, the heating element 23 is a porous heating film, which provides a channel for the vaporization air flow, reduces the operating temperature of the heating element 23, further reduces the generation of e-liquid explosion, and improves the reliability of the product.

Figure 7:
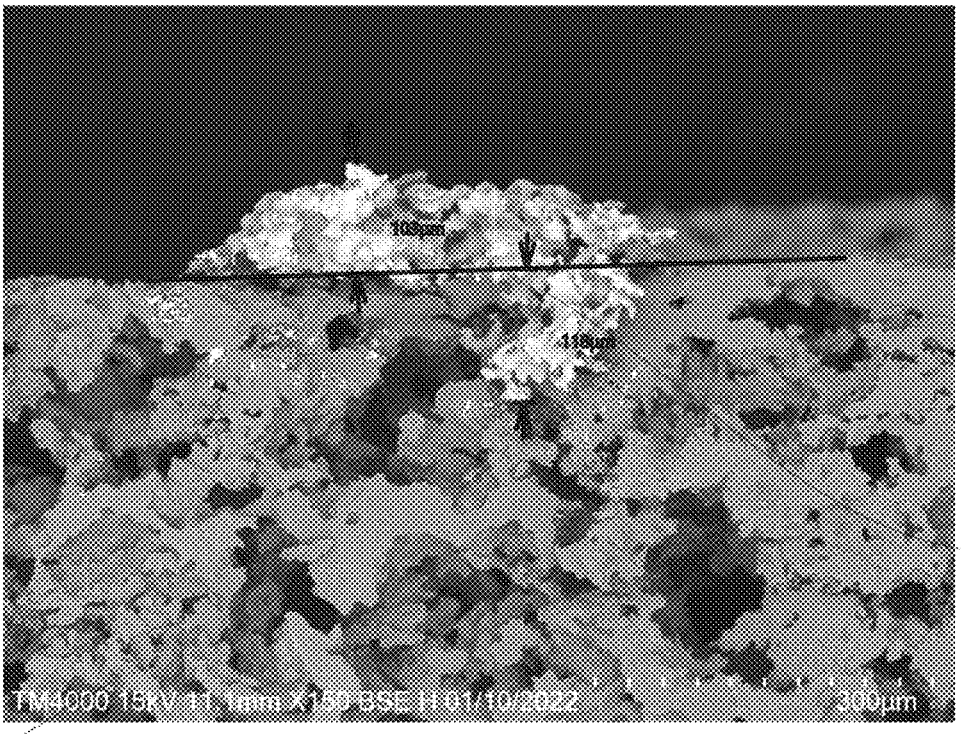
FIG. 7 is an electron microscope diagram of the vaporization core shown in FIG. 1.

FIG. 7 shows an electron microscope diagram of a vaporization core 20 according to some embodiments of the present invention. As shown in the figure, the thickness of the part of the heating element 23 infiltrating into the porous body 21 is about 118 μm, and the thickness of an exposed part is about 103 μm. The infiltration ratio thereof is about 46.6%, which is less than 60%.

In some embodiments, the molding of the heating element 23 on the porous body 21 may adopt the following methods:

(1) The porous heating film is prepared by screen printing. The heating film slurry has a certain fluidity, and the slurry may infiltrate into the pores of the porous body 21 during printing. Because the pores of the porous body 21 are not straight through holes, there is a certain tortuosity, and hole walls are not smooth, which has resistance to slippery infiltration, the porous body 21 with a low porosity has a greater viscosity resistance of the hole walls and a lower infiltration degree of the heating film; and in addition, the infiltration amount may be regulated by adjusting the fluidity of the heating film material at a high temperature or the viscosity of the slurry at a low temperature. The thickness of the heating element 23 may range from 15 μm to 150 μm, and the thickness of the part of the heating element 23 that infiltrates into the porous body 21 does not exceed 60% of the thickness of the entire porous body 21. The control of the infiltration amount is mainly to reduce the overheating boiling of the e-liquid in the porous body 21, so as to reduce the heat loss and improve the vaporization efficiency.

(2) The porous heating film is prepared on the porous body 21 by a magnetron sputtering coating process. The thickness of the porous heating film may range from 1 μm to 5 μm, and the heating film material may form a small amount of infiltration in the pores of the porous body 21. Therefore, the infiltration part of the heating film generates less heat in the porous body 21, and the energy utilization rate is high; and a small amount of infiltration provides the physical fit between the heating film and the porous body 21, enhances the bonding force between a film and a base, and improves the reliability of the vaporization core 20.

Figure 8:
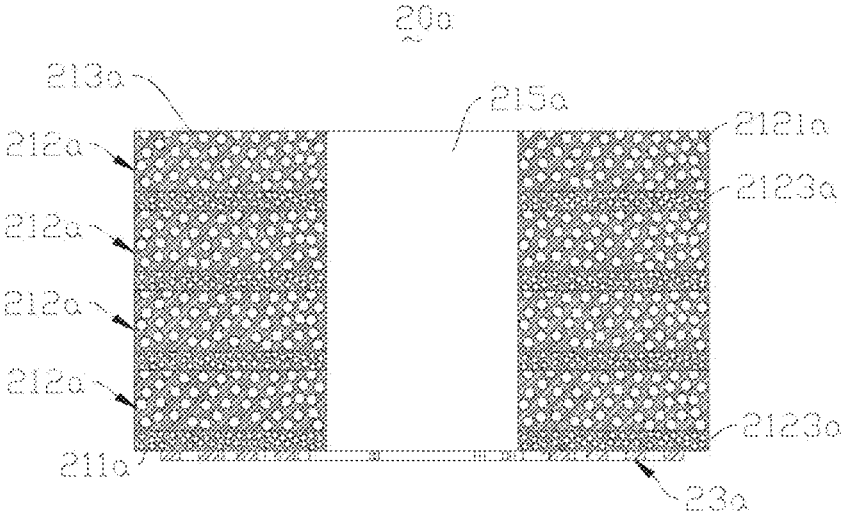
FIG. 8 is a schematic longitudinal sectional structural view of a vaporization core according to some other embodiments of the present invention.

FIG. 8 shows a vaporization core 20*a* according to some other embodiments of the present invention. The vaporization core 20*a* may serve as an alternative of the vaporization core 20, including a porous body 21*a* and a heating element 23*a*. The porous body 21*a* is configured to transmit the liquid aerosol-generation substrate in the liquid storage cavity 13 to the heating element 23*a*. The heating element 23*a* is arranged on the porous body 21*a*, and configured to generate a high temperature after being energized, to heat and vaporize the liquid aerosol-generation substrate.

In some embodiments, the porous body 21*a* may be in a shape of a column, which may include a first surface 211*a*, a second surface 213*a*, and a center channel 215*a*. The first surface 211*a* may be arranged on a bottom part of the porous body 21*a* and configured to install the heating element 23*a*, to form a vaporization surface. The second surface 213*a* and the first surface 211*a* are arranged opposite to each other, and the second surface may be arranged on a top end of the porous body 21*a*, and configured to be in contact with the liquid aerosol-generation substrate to form a liquid absorbing surface. The center channel 215*a* is provided in the porous body 21*a* and extends from the first surface 211*a* to the second surface 213*a*, to communicate the vaporization cavity 11 with the air outlet channel 15. It may be understood that, the porous body 21*a* is not limited to the shape of a column, but may also be in a shape of a flat plate.

In some embodiments, the porous body 21*a* may include n ($2 \leq n \leq 30$) unit layers 212*a*, and these unit layers 212*a* are stacked along a direction from the first surface 211*a* to the second surface 213*a*. Each unit layer 212*a* may include a liquid storage advantage layer 2121*a* away from the first surface 211*a* and a liquid locking advantage layer 2123*a* close to the first surface 211*a*, so that the liquid storage advantage layer 2121*a* and the liquid locking advantage layer 2123*a* of the porous body 21*a* are alternately arranged, to realize a steeper gradient drop than that of a porous body of the same thickness with a single porosity, so as to provide a stronger heat and mass transfer driving force and provide a faster liquid supplying capability for inhalation.

In some embodiments, the thickness of the porous body 21*a* (a distance from the first surface 211*a* to the second surface 213*a*) may range from 0.8 mm to 3.0 mm, and an average porosity thereof may range from 50% to 75%. The thickness of each unit layer 212*a* may range from 0.10 mm to 1.5 mm, and the thickness of the liquid locking advantage layer 2123*a* of each unit layer 212*a* may range from 10 μm to 200 μm.

In some embodiments, the liquid storage advantage layer 2121*a* may be a large-pore-size structure layer, and the liquid locking advantage layer 2123*a* may be a small-pore-size structure layer, where the liquid locking advantage layer 2123*a* provides the porous body 21*a* with a stronger support and liquid locking function than the liquid storage advantage layer 2121*a*; and the liquid storage advantage layer 2121*a* provides the porous body 21*a* with functions such us a larger amount of liquid storage, faster liquid supplying, and stronger heat insulation than the liquid locking advantage layer 2123*a*, so as to reduce heat loss and provide a higher energy utilization rate for the vaporization core 20*a*.

In some embodiments, an average pore size of the liquid storage advantage layer 2121*a* is 1.5 to 2.5 times of an average pore size of the liquid locking advantage layer 2123*a*. In some embodiments, the average pore size of the liquid storage advantage layer 2121*a* may range from 50 μm to 150 μm, and the average pore size of the liquid locking advantage layer 2123*a* may range from 20 μm to 100 μm.

In some embodiments, the porous body 21 may be porous alumina ceramic, porous silicon oxide, porous cordierite, porous silicon carbide, porous silicon nitride, porous mullite, or composite porous ceramic formed integrally. It may be understood that the porous body 21 is not limited thereto, and may also be made of other materials suitable for flow casting or coating.

In some embodiments, the porous body 21*a* may be formed by flow casting or extrusion, and specific examples are as follows:

(1) Flow casting process, the flow casting process itself is suitable for preparing a multilayer structure, and for example: (A) green compacts with different pore sizes may be flow cast first, and then a periodic layered structure may be prepared by periodically stacking and then co-firing the green compacts; and (B) it is also possible to prepare the periodic layered structure by adjusting a recipe by flowing green compacts with different pore sizes on different sides at once according to the difference in density and particle size of each component in the recipe, thus showing the difference in suspension capabilities in the slurry, and then stacking and co-firing the multilayered green compacts.

(2) Using extrusion molding process, a variety of green compacts with different pore sizes are extruded by recipe adjustment, and then multilayered green compacts were stacked and co-fired to form the periodic layered structure.

(3) Preparing by combination of a variety of processes, for example, a green compact with a pore size is flow casted first, then a green compact with another pore size is extruded or injection molded, and then a variety of green compacts with different pore sizes are stacked and co-fired periodically to prepare the periodic layered structure.

(4) Using a coating process, an underlying substrate is a large-pore-size structure layer, followed by coating performed on the substrate and secondary sintering to form a small-pore-size structure layer. According to different pore size requirements, the formulation and molding parameters of the porous body material may be adjusted artificially to form a required porous body structure with hierarchical pore sizes.

In some embodiments, the heating element 23*a* is at least partially exposed to a lowest end of the porous body 21*a* and the surface of the liquid locking advantage layer 2123*a* in communication with the vaporization cavity 11 in an air guiding manner, and the structure and molding method of the heating element 23*a* may be the same as those of the heating element 23, which are not described herein again.

Figure 9:
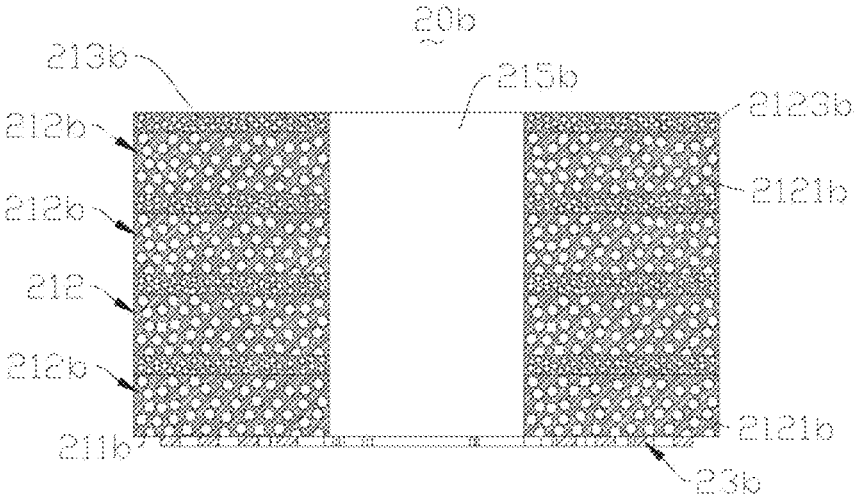
FIG. 9 is a schematic longitudinal sectional structural view of a vaporization core according to still some other embodiments of the present invention.

FIG. 9 shows a vaporization core 20*b* according to still some other embodiments of the present invention. The vaporization core 20*b* may serve as an alternative of the vaporization core 20, including a porous body 21*b* and a heating element 23*b*. The porous body 21*b* is configured to transmit the liquid aerosol-generation substrate in the liquid storage cavity 13 to the heating element 23*b*. The heating element 23*b* is arranged on the porous body 21*b*, and configured to generate a high temperature after being energized, to heat and vaporize the liquid aerosol-generation substrate.

In some embodiments, the porous body 21*b* may be in a shape of a column, which may include a first surface 211*b*, a second surface 213*b*, and a center channel 215*b*. The first surface 211*b* is arranged on a bottom part of the porous body 21*b* and configured to install the heating element 23*b*, to form a vaporization surface. The second surface 213*b* and the first surface 211*b* are arranged opposite to each other on the top end of the porous body 21*b*, and the second surface is configured to be in contact with the liquid aerosol-generation substrate to form a liquid absorbing surface. The center channel 215*b* is arranged in the porous body 21*b* and extends from the first surface 211*b* to the second surface 213*b*, to communicate the vaporization cavity 11 with the air outlet channel 15. It may be understood that, the porous body 21*b* is not limited to the shape of a column, but may also be in a shape of a flat plate.

In some embodiments, the porous body 21*b* may be porous alumina ceramic, porous silicon oxide, porous cordierite, porous silicon carbide, porous silicon nitride, porous mullite, or composite porous ceramic formed integrally. However, the porous body is not limited thereto, and may also be other materials suitable for flow casting or coating. The thickness of the porous body 21*b* may range from 0.8 mm to 3.0 mm, and an average porosity thereof may range from 50% to 75%. In some embodiments, the porous body 21*b* may be a periodic layered structure, which may include n ($2 \leq n \leq 30$) unit layers 212*b*, where the thickness of each unit layer 212*b* may range from 0.1 mm to 1.5 mm, and each unit layer 212*b* may include a liquid storage advantage layer 2121*b* close to the first surface 211*b* and a liquid locking advantage layer 2123*b* away from the first surface 211*b*, which are configured to reduce a liquid supplying path, to provide a faster liquid supplying capability for inhalation. In some embodiments, the thickness of the liquid locking advantage layer 2123*b* may range from 10 μm to 200 μm.

In some embodiments, the liquid storage advantage layer 2121*b* may be a large-pore-size structure layer, and the liquid locking advantage layer 2123*b* may be a small-pore-size structure layer, where the liquid locking advantage layer 2123*b* provides the porous body 21*b* with a stronger support and liquid locking function than the liquid storage advantage layer 2121*b*; and the liquid storage advantage layer 2121*b* provides the porous body 21*b* with functions such us a larger amount of liquid storage, faster liquid supplying, and stronger heat insulation than the liquid locking advantage layer 2123*b*, so as to reduce heat loss and provide a higher energy utilization rate for the vaporization core 20*b*. In some embodiments, an average pore size of the liquid storage advantage layer 2121*b* is 1.5 to 2.5 times of an average pore size of the liquid locking advantage layer 2123*b*.

In some embodiments, under the condition of the same thickness, a gradient drop of a porous body with a uniform pore size is flat, and a porous body 21*b* of a periodic n-layered (n is more than or equal to 2) structure can realize a steeper gradient drop, to provide a stronger heat and mass transfer driving force.

As shown in FIG. 9, in some embodiments, the heating element 23*b* may be a porous heating film, which may be covered on the surface of the liquid storage advantage layer 2121*b* of the unit layer 212*b* close to the first surface 211*b* by means of heating film screen printing, vacuum coating, and the like, and partially infiltrate into the liquid storage advantage layer 2121*b*. For the heating element 23*b* laid on the liquid storage advantage layer 2121*b*, considering that the average pore size of the liquid storage advantage layer 2121*b* is larger, the liquid storage capability is strong, and the infiltration of the heating element 23*b* is easier. In order to ensure that the e-liquid is fully vaporized, and reduce the energy transmission of the heating element 23*b* to the part of e-liquid that cannot be vaporized, to reduce e-liquid explosion, the thickness of the liquid storage advantage layer 2121*b* may be limited from 0.1 mm to 1.70 mm, so that the heating element 23*b* realizes high vaporization efficiency. The structure and molding method of the heating element 23*b* may be the same as those of the heating element 23, and details are not described herein again.

Figure 10:
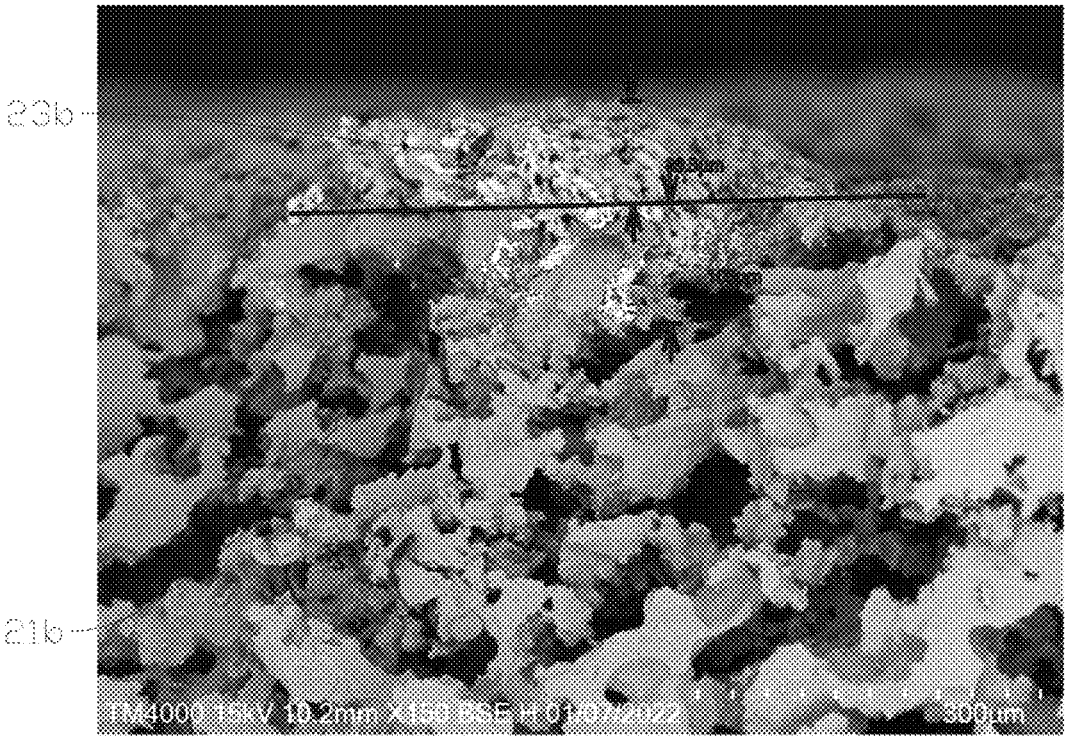
FIG. 10 is an electron microscope diagram of the vaporization core shown in FIG. 9.

FIG. 10 shows an electron microscope diagram of a vaporization core 20*b* according to some embodiments. As shown in the figure, the maximum depth of the part of the heating element 23*b* infiltrating into the porous body 21 is about 105 μm, and the thickness of an exposed part is about 89.3 μm. The infiltration ratio thereof is about 54%, which is less than 60%.

Figure 11:
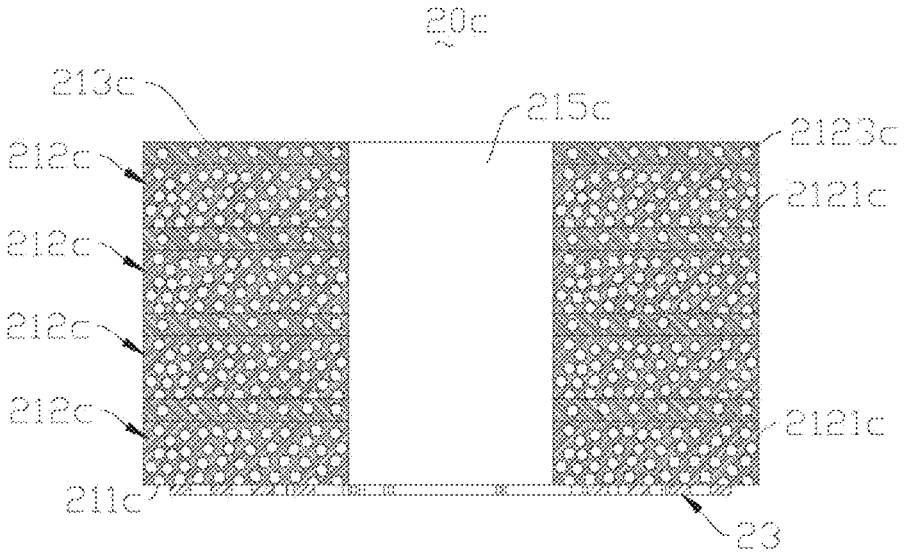
FIG. 11 is a schematic longitudinal sectional structural view of a vaporization core according to yet some other embodiments of the present invention.

FIG. 11 shows a vaporization core 20*c* according to yet some other embodiments of the present invention. The vaporization core 20*c* may serve as an alternative of the vaporization core 20, including a porous body 21*c* and a heating element 23*c*. The porous body 21*c* is configured to transmit the liquid aerosol-generation substrate in the liquid storage cavity 13 to the heating element 23*c*. The heating element 23*c* is arranged on the porous body 21*c*, and configured to generate a high temperature after being energized, to heat and vaporize the liquid aerosol-generation substrate.

In some embodiments, the porous body 21*c* may be in a shape of a column, which may include a first surface 211*c*, a second surface 213*c*, and a center channel 215*c*. The first surface 211*c* is arranged on a bottom part of the porous body 21*c* and configured to install the heating element 23*c*, to form a vaporization surface. The second surface 213*c* and the first surface 211*c* are arranged opposite to each other on the top end of the porous body 21*c*, and the second surface is configured to be in contact with the liquid aerosol-generation substrate to form a liquid absorbing surface. The center channel 215*c* is arranged in the porous body 21*c* and extends from the first surface 211*c* to the second surface 213*c*, to communicate the vaporization cavity 11 with the air outlet channel 15. It may be understood that, the porous body 21*c* is not limited to the shape of a column, but may also be in a shape of a flat plate.

In some embodiments, the porous body 21*c* may be porous alumina ceramic, porous silicon oxide, porous cordierite, porous silicon carbide, porous silicon nitride, porous mullite, or composite porous ceramic formed integrally. However, the porous body not limited thereto, and may also be other materials suitable for flow casting or coating. The thickness of the porous body 21*c* may range from 0.8 mm to 3.0 mm, and an average porosity thereof may range from 50% to 75%. In some embodiments, the porous body 21*c* may be a periodic layered structure, which may include n ($2 \leq n \leq 30$) unit layers 212*c*, where the thickness of each unit layer 212*c* may range from 0.10 mm to 1.5 mm, and each unit layer 212*c* may include a liquid storage advantage layer 2121*c* close to the first surface 211*c* and a liquid locking advantage layer 2123*c* away from the first surface 211*c*, which are configured to reduce a liquid supplying path, to provide a faster liquid supplying capability for inhalation. In some embodiments, the thickness of the liquid locking advantage layer 2123 may range from 10 μm to 200 μm.

In some embodiments, the liquid storage advantage layer 2121*c* may be a high porosity layer, and the liquid locking advantage layer 2123*c* may be a low porosity layer, where the liquid locking advantage layer 2123*c* provides the porous body 21*c* with a stronger support and liquid locking function than the liquid storage advantage layer 2121*c*; and the liquid storage advantage layer 2121*c* provides the porous body 21*c* with functions such us a larger amount of liquid storage, faster liquid supplying, and stronger heat insulation than the liquid locking advantage layer 2123*c*, so as to reduce heat loss and provide a higher energy utilization rate for the vaporization core 20*c*. In some embodiments, a porosity of the liquid storage advantage layer 2121*c* is 1.2 to 2 times of a porosity of the liquid locking advantage layer 2123*c*. Specifically, the porosity of the liquid storage advantage layer 2121*c* may range from 55% to 90%, and the porosity of the liquid locking advantage layer 2123*c* may range from 45% to 70%. In some embodiments, under the condition of the same thickness, a gradient drop of a porous body with a uniform porosity is flat, and a porous body of a periodic n-layered (n is greater than or equal to 2) structure can realize a steeper gradient drop, to provide a stronger heat and mass transfer driving force.

As shown in FIG. 11, in some embodiments, the heating element 23*c* may be a porous heating film, which may be covered on the surface of the liquid storage advantage layer 2121*c* of the unit layer 212*c* close to the first surface 211*c* by means of heating film screen printing, vacuum coating, and the like, and partially infiltrate into the liquid storage advantage layer 2121*c*. For the heating element 23*c* laid on the liquid storage advantage layer 2121*c*, considering that the porosity of the liquid storage advantage layer 2121*c* is higher, the liquid storage capability is strong, and the infiltration of the heating element 23*c* is easier. In order to ensure that the e-liquid is fully vaporized, and reduce the energy transmission of the heating element 23*c* to the part of e-liquid that cannot be vaporized, to reduce e-liquid explosion, the thickness of the liquid storage advantage layer 2121*c* may be limited from 0.1 mm to 1.70 mm, so that the heating element 23*c* realizes high vaporization efficiency. The structure and molding method of the heating element 23*c* may be the same as those of the heating element 23, and details are not described herein again.

It should be noted that, although the heating element in the above embodiments is formed by a porous heating film, in some other embodiments, the heating element is not limited thereto, and other heating bodies such as a metal heating sheet or a non-porous heating film are also applicable.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporization core for an electronic vaporization device, comprising:

a porous body; and a heating film arranged on a surface of the porous body, wherein the porous body comprises at least one unit layer, the at least one unit layer comprising a liquid storage advantage layer and a liquid locking advantage layer combined with the liquid storage advantage layer, wherein the heating film is combined with a surface of the liquid locking advantage layer and at least partially infiltrates in the liquid locking advantage layer, wherein the liquid storage advantage layer comprises a high porosity layer, wherein the liquid locking advantage layer comprises a low porosity layer, and wherein an average pore size of the low porosity layer ranges from 20 μm to 100 μm.

2. The vaporization core of claim 1, wherein the porous body comprises a first surface and a second surface opposite the first surface, wherein the at least one unit layer comprises at least two unit layers, the at least two unit layers being arranged sequentially along a direction from the first surface to the second surface, wherein one unit layer of the at least two unit layers comprises at least a liquid locking advantage layer, and each other unit layer of the at least two unit layers comprises a liquid storage advantage layer and a liquid locking advantage layer combined with the liquid storage advantage layer, and wherein the heating film is combined with a surface of an outermost liquid locking advantage layer of the at least two unit layers.

3. The vaporization core of claim 2, wherein each unit layer of the at least two unit layers comprises a liquid storage advantage layer and a liquid locking advantage layer stacked together with the liquid storage advantage layer, and wherein the liquid storage advantage layers and the liquid locking advantage layers of the at least two unit layers are stacked together along a direction from the first surface to the second surface.

4. The vaporization core of claim 1, wherein a thickness of the liquid locking advantage layer ranges from 10 μm to 200 μm.

5. The vaporization core of claim 1, wherein a thickness of the porous body ranges from 0.8 mm to 3.0 mm.

6. The vaporization core of claim 1, wherein an average porosity of the porous body ranges from 50% to 75%.

7. The vaporization core of claim 1, wherein a thickness of each unit layer ranges from 0.1 mm to 1.5 mm.

8. The vaporization core of claim 1, wherein an average pore size of the high porosity layer is 1.5 to 2.5 times an average pore size of the low porosity layer.

9. The vaporization core of claim 1, wherein an average pore size of the high porosity layer ranges from 50 μm to 150 μm.

10. The vaporization core of claim 1 wherein a porosity of the high porosity layer is 1.2 to 2 times a porosity of the low porosity layer.

11. The vaporization core of claim 1, wherein a porosity of the high porosity layer ranges from 55% to 90%, and wherein a porosity of the low porosity layer ranges from 55% to 90%.

12. The vaporization core of claim 1, wherein the porous body comprises porous alumina ceramic, porous silicon oxide, porous cordierite, porous silicon carbide, porous silicon nitride, porous mullite, or composite porous ceramic formed integrally.

13. The vaporization core of claim 1, wherein the heating film comprises a porous heating film.

14. The vaporization core of claim 1, wherein a thickness of the heating film ranges from 15 μm to 150 μm or from 1 μm to 5 μm.

15. The vaporization core of claim 1, wherein an infiltration ratio of the heating film is less than 60%.

16. An electronic vaporization device, comprising:

the vaporization core of claim 1.

* * * * *